US011280161B2

(12) United States Patent
Stone

(10) Patent No.: US 11,280,161 B2
(45) Date of Patent: Mar. 22, 2022

(54) SHEARABLE SPLIT BALL SEAT

(71) Applicant: Matthew Stone, Humble, TX (US)

(72) Inventor: Matthew Stone, Humble, TX (US)

(73) Assignee: BAKER HUGHES OILFIELD OPERATIONS LLC, Houston, TX (US)

( * ) Notice: Subject to any disclaimer, the term of this patent is extended or adjusted under 35 U.S.C. 154(b) by 0 days.

(21) Appl. No.: 16/990,537

(22) Filed: Aug. 11, 2020

(65) Prior Publication Data

US 2020/0386072 A1 Dec. 10, 2020

Related U.S. Application Data

(62) Division of application No. 16/431,367, filed on Jun. 4, 2019, now Pat. No. 10,954,751.

(51) Int. Cl.

| | |
|---|---|
| ***E21B 34/14*** | (2006.01) |
| ***E21B 34/06*** | (2006.01) |
| ***E21B 23/00*** | (2006.01) |
| ***E21B 23/04*** | (2006.01) |
| ***E21B 33/00*** | (2006.01) |
| *E21B 43/26* | (2006.01) |

(52) U.S. Cl.

CPC ..... *E21B 34/142* (2020.05); *E21B 23/006* (2013.01); *E21B 23/0413* (2020.05); *E21B 33/00* (2013.01); *E21B 34/063* (2013.01); *E21B 34/14* (2013.01); *E21B 43/26* (2013.01); *E21B 2200/04* (2020.05); *E21B 2200/06* (2020.05)

(58) Field of Classification Search

CPC .... E21B 34/142; E21B 33/00; E21B 23/0413; E21B 23/006; E21B 34/063; E21B 34/14; E21B 2200/04; E21B 2200/06; E21B 43/26

See application file for complete search history.

(56) References Cited

U.S. PATENT DOCUMENTS

| | | | | |
|---|---|---|---|---|
| 8,899,334 | B2 * | 12/2014 | Merron | E21B 34/14 166/373 |
| 9,103,189 | B2 * | 8/2015 | Pacey | E21B 33/12 |
| 9,133,696 | B2 * | 9/2015 | Pacey | E21B 41/00 |
| 9,238,953 | B2 | 1/2016 | Fleming et al. | |
| 9,494,009 | B2 * | 11/2016 | Pacey | E21B 33/12 |
| 9,777,553 | B2 * | 10/2017 | Silva | E21B 34/14 |
| 10,246,971 | B2 | 4/2019 | Doane et al. | |
| 2005/0072572 | A1 | 4/2005 | Churchill | |
| 2009/0159289 | A1 * | 6/2009 | Avant | E21B 34/14 166/316 |
| 2011/0253383 | A1 * | 10/2011 | Porter | E21B 34/103 166/373 |

(Continued)

*Primary Examiner* — Nicole Coy
(74) *Attorney, Agent, or Firm* — Cantor Colburn LLP

(57) ABSTRACT

A frac sleeve assembly and method of operation. The frac sleeve assembly includes a ball seat that retains a frac ball. The ball seat moves within a sleeve. The sleeve includes a profile that separates the first half and the second half to allow passage of the frac ball through the ball seat when the ball seat moves within the sleeve. Alternatively, the ball seat has a ring for receiving the frac ball and the sleeve has a protrusion that selectively engages a shifting pin to move the ring with respect to a ridge to release the ball from the ball seat when the ball seat moves within the sleeve.

7 Claims, 11 Drawing Sheets

(56) References Cited

U.S. PATENT DOCUMENTS

| | | | | |
|---|---|---|---|---|
| 2012/0205120 | A1* | 8/2012 | Howell | E21B 34/10 166/373 |
| 2012/0205121 | A1* | 8/2012 | Porter | E21B 21/103 166/373 |
| 2012/0305236 | A1* | 12/2012 | Gouthaman | E21B 41/00 166/118 |
| 2016/0362962 | A1 | 12/2016 | Gonzalez | |

* cited by examiner

SHEARABLE SPLIT BALL SEAT

CROSS-REFERENCE TO RELATED APPLICATIONS

This application is a divisional application of U.S. patent application Ser. No. 16/431,367 filed Jun. 4, 2019, the contents of which are incorporated by reference herein in their entirety.

BACKGROUND

In the resource recovery industry, formation fracturing ("fracking") is used to increase a hydrocarbon output from a reservoir by introducing fracking fluid from a production string into the reservoir. The production string includes a port and a frac sleeve that opens and closes the port to control flow of frac fluid into the reservoir. The frac sleeve includes a tubular passage with a ball seat therein. A ball is dropped through the production string to land on the ball seat, thereby blocking a fluid passage through the frac sleeve. Fluid pressure can be then applied to the ball and ball seat in order to move the frac sleeve axially from a closed position, thereby opening the port. When desired, a disintegrating fluid is pumped downhole to dissolve the ball, thereby releasing the fluid pressure on the frac sleeve, allowing the frac sleeve to move back to its closed position, thereby closing the port. A problem that occurs during ball dissolution is that the ball can become cemented into the ball seat, thereby preventing closure of the port as desired. Accordingly, there is a need for a ball seat that allows for the ball to pass through the ball seat without cementation.

SUMMARY

In one embodiment, a frac sleeve assembly is disclosed, the frac sleeve assembly including a ball seat having a first half and a second half, wherein the first half and the second half are matable to cooperatively retain a frac ball at the ball seat; and a sleeve within which the ball seat moves, the sleeve including a profile configured to separate the first half and the second half to allow passage of the frac ball through the ball seat.

In another embodiment, a method of operating a frac assembly is disclosed. A frac ball is received at a ball seat including a first half and a second half, wherein the first half and the second half are matable to cooperatively retain the frac ball at the ball seat. The ball seat moves against a profile to separate the first half and the second half to allow passage of the frac ball through the ball seat.

In yet another embodiment, a frac sleeve assembly is disclosed. The frac sleeve assembly includes a ball seat having a ridge for receiving a ball, and a slot; a ring assembly including a ring and an associated shifting pin that extends through the slot; and a sleeve within which the ball seat moves, the sleeve having a protrusion that selectively engages the shifting pin to move the ring with respect to the ridge of the ball seat to release the ball from the ball seat.

In yet another embodiment, a method of operating a frac sleeve assembly is disclosed. A ball is received at a ridge of a ball seat of the frac sleeve assembly, wherein the ball seat includes slot and a ring assembly, and the ring assembly includes a ring and an associated shifting pin that extends through the slot. The ball seat moves within a sleeve having a protrusion in order to engage the protrusion with the shifting pin to move the ring with respect to the ridge of the ball seat to release the ball from the ball seat.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
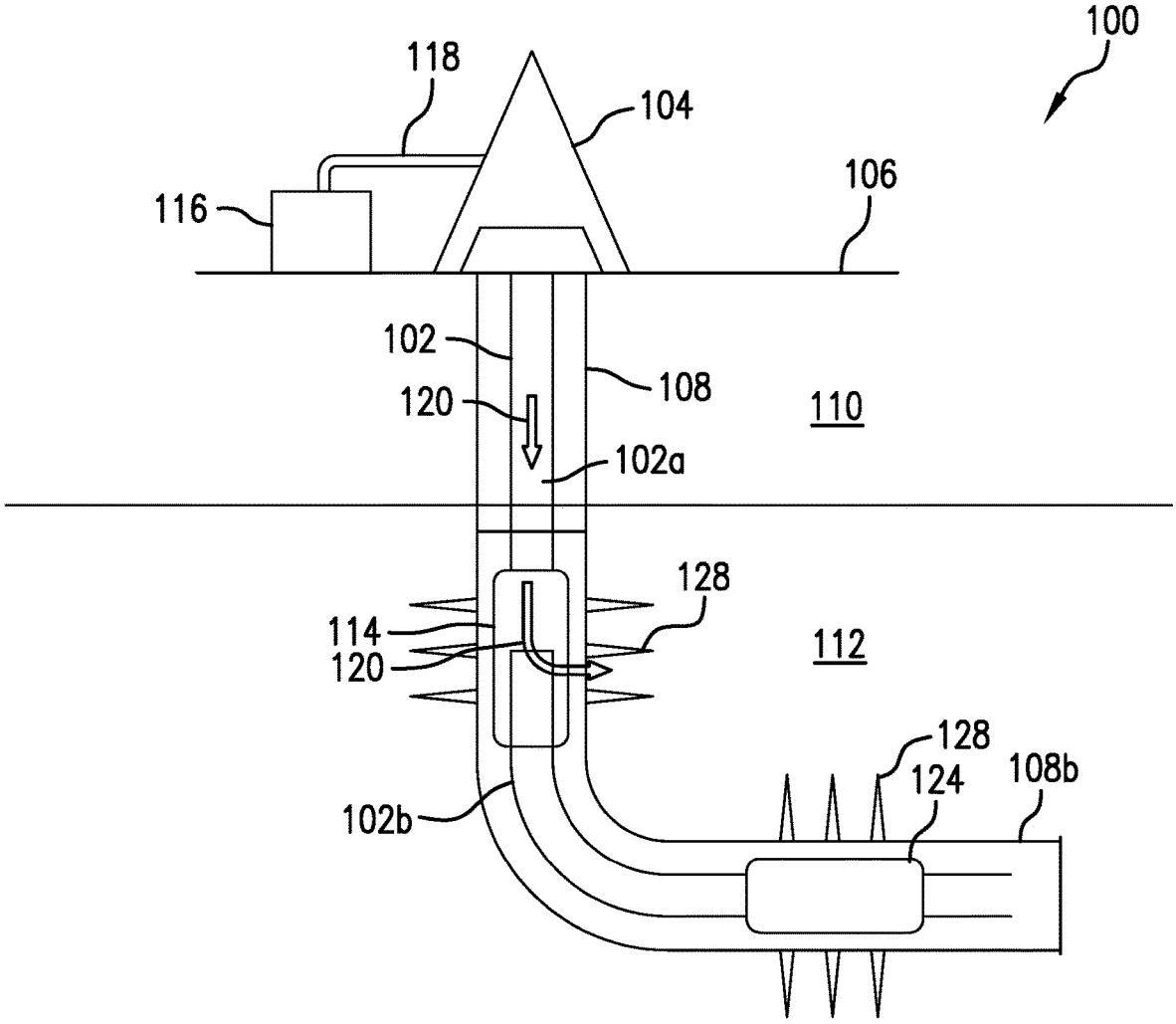
FIG. 1 shows an illustrative production system.

Referring to FIG. 1, an illustrative production system 100 is shown. The production system 100 includes a production string 102 extending from a rig 104 located at a surface location 106. The production string 102 extends through a wellbore 108 penetrating a formation 110 and a reservoir 112 in the formation 110. A fracture ("frac") assembly 114 is disposed on the production string 102 at a location in the reservoir 112 for the purposes of fracking the reservoir 112. The frac assembly 114 is disposed between a first section 102*a* of the production string 102 and a second section 102*b* of the production string 102. A second frac assembly 124 can be disposed at a lower end of the second section 102*b*. Additional frac assemblies (not shown) can also be disposed at lower sections of the production string 102. As shown in FIG. 1, the wellbore 108 can deviate to have a horizontal section 108*b* and the production string 102 can deviate along with the wellbore 108 to extend through the horizontal section 108*b*. One or more of the frac assemblies (such as second frac assembly 124) can be disposed within the horizontal section.

In order to perform a frac operation, a frac fluid 120 is pumped from a frac fluid storage device 116 through delivery pipe 118 and down through the production string 102 to exit the frac assembly 114 into the reservoir 112. In various embodiments, various perforations 128 can be previously formed in the reservoir 112 through which the frac fluid 120 passes into the reservoir 112. Proppant entrained in the frac fluid 120 is carried into the perforations 128 in order to prop the perforations 128 open, thereby allowing for increased hydrocarbon recovery from the reservoir 112. As discussed below with respect to FIG. 2, the frac assembly 114 includes elements that can be moved therein in order to control the frac operation by opening a port to release the frac fluid 120 into the reservoir 112 and by closing the port to stop the flow of frac fluid 120 into the reservoir 112.

Figure 2:
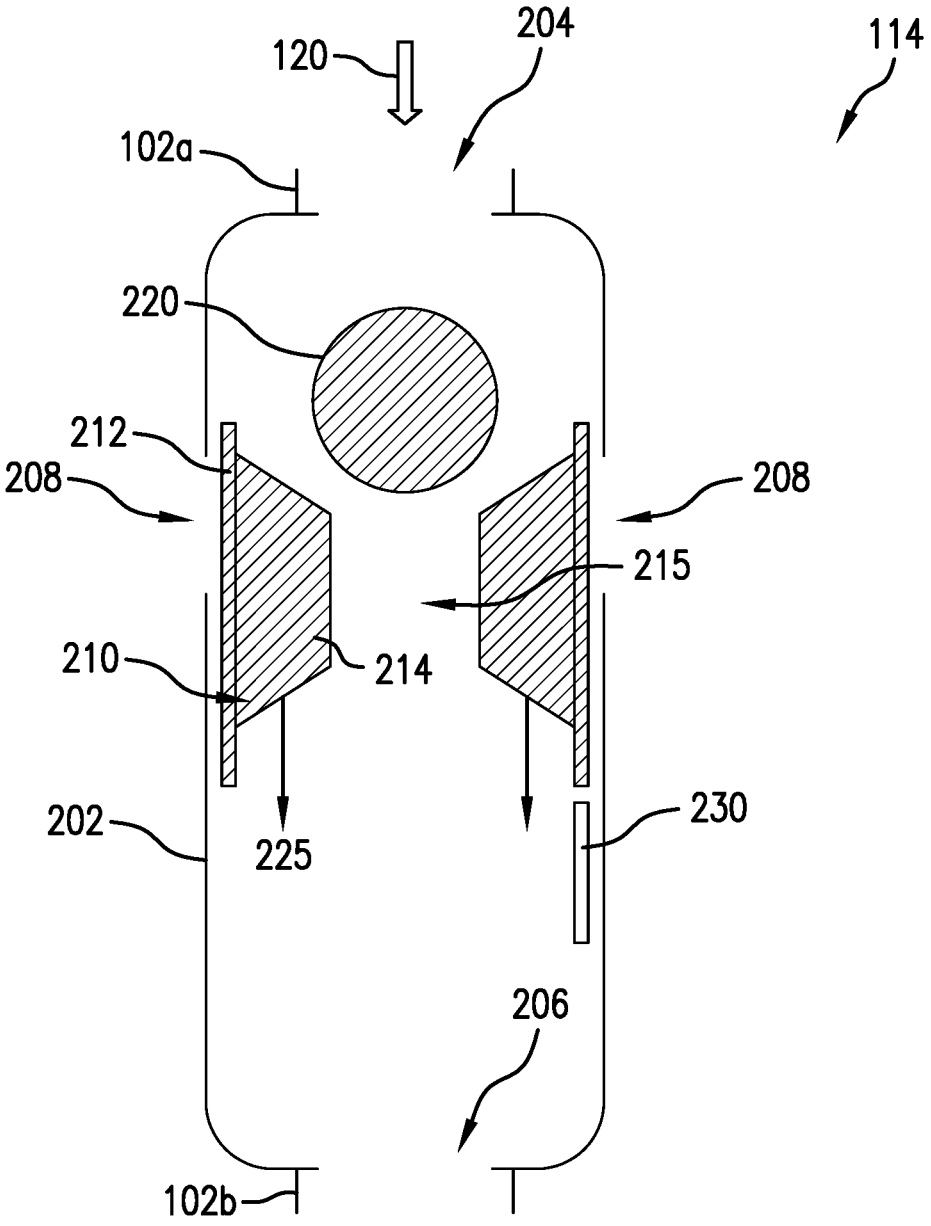
FIG. 2 shows a detailed diagram of an illustrative frac assembly of the production system of FIG. 1 in various embodiments.

FIG. 2 shows a detailed diagram of an illustrative frac assembly 114 of the production system 100 in various embodiments. The frac assembly 114 includes a housing 202 coupled to the production string 102. The housing 202 includes an inlet 204 at an intersection of the housing 202 and the first section 102*a* of the production string 102. The housing 202 also includes an outlet 206 at an intersection of the housing 202 and the second section 102*b* of the production string 102. The housing 202 further includes one or more ports 208 on the side of the housing 202 for delivery of frac fluid 120 from the frac assembly 114 into the reservoir 112. The ports 208 can be opened or closed based on a position of a frac sleeve assembly 210.

The frac sleeve assembly 210 includes a sleeve 212 and a ball seat 214 that define a fluid passage 215 through the frac sleeve assembly 210. The frac sleeve assembly 210 can move between a first position and a second position. The first position is relatively closer to the inlet 204 than the second position. When the frac sleeve assembly 210 is in the first position, the sleeve 212 covers a port 208 of the frac assembly 114, thereby closing the port 208. When the frac sleeve assembly 210 is in the second position, the sleeve 212 is away from the port 208, thereby opening the port 208. The port 208 can be a plurality of ports in various embodiments.

Fluid can pass from the inlet 204 to the outlet 206 by passing through the frac sleeve assembly 210. The frac sleeve assembly 210 can be moved from the first position to the second position by dropping a ball 220 into the production string 102 at the surface and allowing the ball 220 to settle onto the ball seat 214, thereby blocking the flow of fluid from the inlet 204 to the outlet 206. The frac fluid 120 entering the frac assembly 114 from the inlet 204 then applies a fluid pressure on the ball 220, forcing the frac sleeve assembly 210 to move towards the outlet 206 as indicated by arrows 225 (i.e., into the second position). In various embodiments, the frac sleeve assembly 210 is originally secured to the housing 202 via shear screws (not shown) and the fluid pressure is applied above a breaking threshold for the shear screws. Once the shear screws are broken, the frac sleeve assembly 210 moves toward the outlet 206 under fluid pressure and uncovers ports 208, allowing the frac fluid 120 to flow out of the housing 202 via the port 208 and into the reservoir 112. The port 208 is closed by moving the frac sleeve assembly 210 toward the inlet 204 (i.e, back to the first position). In various embodiments, the frac sleeve assembly 210 is moved toward the inlet 204 by disintegrating or dissolving the ball 220, thereby relieving the downward pressure of the fluid on the ball seat 214 and frac sleeve assembly 210. A biasing device 230 such as a spring provides a force directed toward inlet 204*a* in order to return the frac sleeve assembly 210 to its original position in which it covers, and thereby closes, port 208. In an alternate embodiment, the biasing device 230 can be replaced with a lock that allows the frac sleeve assembly 210 to be locked into the open position.

In order to disintegrate the ball 220, a disintegrating fluid is pumped down the production string to the ball 220. The disintegrating fluid can be the frac fluid. The ball 220 is designed to disintegrate when exposed to the disintegrating fluid at a selected temperature. In general, the disintegrating fluid that forces the ball 220 into the ball seat 214 is provided into the production string 102 at a temperature (e.g., about 100° Celsius) below a reaction temperature for the ball 220 and the disintegrating fluid. Over time, the temperature of the disintegrating fluid rises to thermal equilibrium with the downhole temperature. At the downhole temperature, the disintegrating fluid chemically interacts with the ball 220 in order to disintegrate the ball 220. The disintegration process is designed to reduce the size of the ball 220, allowing the ball 220 to pass through the ball seat 214, thereby relieving the pressure from the frac sleeve assembly 210 and allowing the frac sleeve assembly 210 to return to its original position. The ball seat can also be locked into an open position During dissolution, the ball 220 can become cemented into position in the ball seat 214, making it difficult for the fluid passage of the ball seat to be opened up, thereby preventing closure of the port 208. Embodiments discussed below provide methods for ensuring removal of the ball 220 from the ball seat 214 and closure of port 208.

Figure 3:
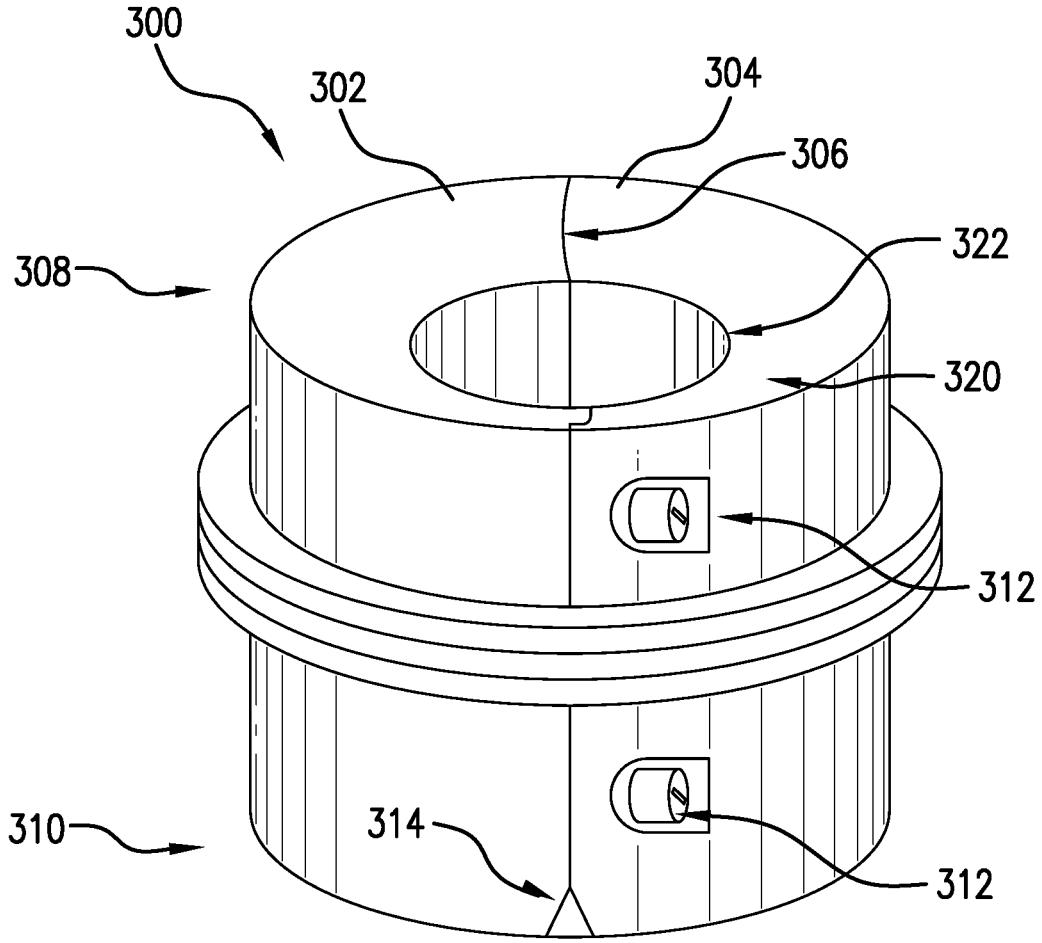
FIG. 3 shows a ball seat in one embodiment.

FIG. 3 shows a ball seat 300 in one embodiment. The ball seat 300 includes a first half 302 and a second half 304 formed by a split 306 that defines an axially-extending plane. The first half 302 mates to the second half 304 to form the ball seat 300. The assembled ball seat 300 includes a first end 308 proximate the inlet and a second end 310 proximate the outlet. The first end 308 includes a funnel section 320 with a ridge 322. The ridge 322 captures a frac ball dropped into the funnel section 320. One or more shear screws 312 secure the first half 302 and the second half 304 together. The first half 302 and second half 304 include recessed regions at the second end 310. When the first half 302 is mates to the second half 304, the recess regions form a notch 314 at the split 306.

Figure 4:
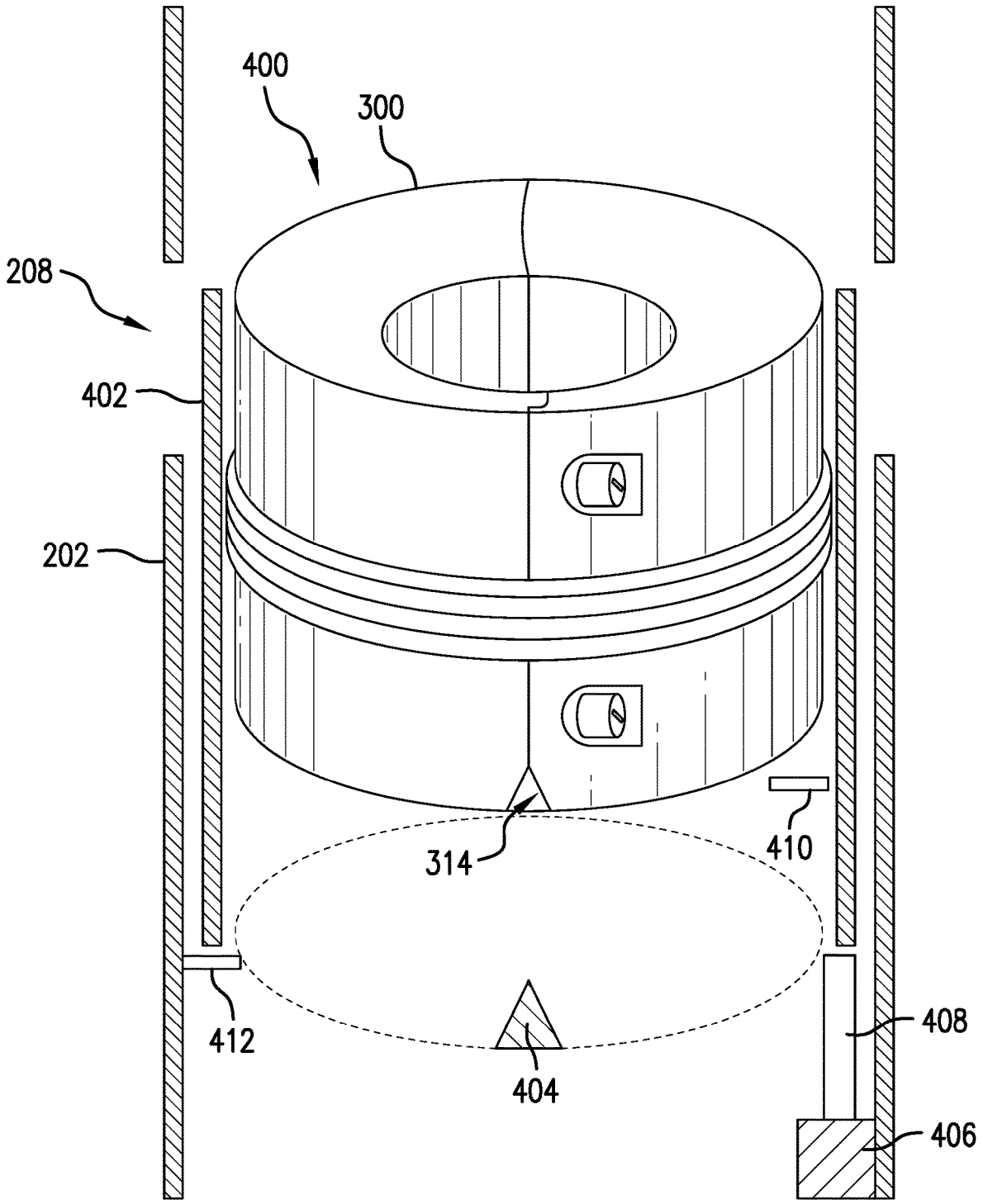
FIG. 4 shows a frac sleeve assembly including the ball seat of FIG. 3.

FIG. 4 shows a frac sleeve assembly 400 including the ball seat 300 of FIG. 3. The frac assembly 400 is shown within a housing 202 of a frac assembly in a first operating stage in which the frac sleeve assembly 400 covers port 208 of the housing 202. The frac sleeve assembly 400 moves axially within the housing 202. The frac sleeve assembly 400 includes a sleeve 402 and the ball seat 300 of FIG. 3. The ball seat 300 is capable over moving axially within the sleeve 402. A frac sleeve shear pin 412 maintains the frac sleeve assembly 400 in a first position within the housing 202 to cover port 208. A structure 406 supports biasing member 408 to provide a force in a direction of the inlet to the housing 202. A ball seat shear pin 410 maintains the ball seat 300 at a selected location within the sleeve 402.

Figure 5:
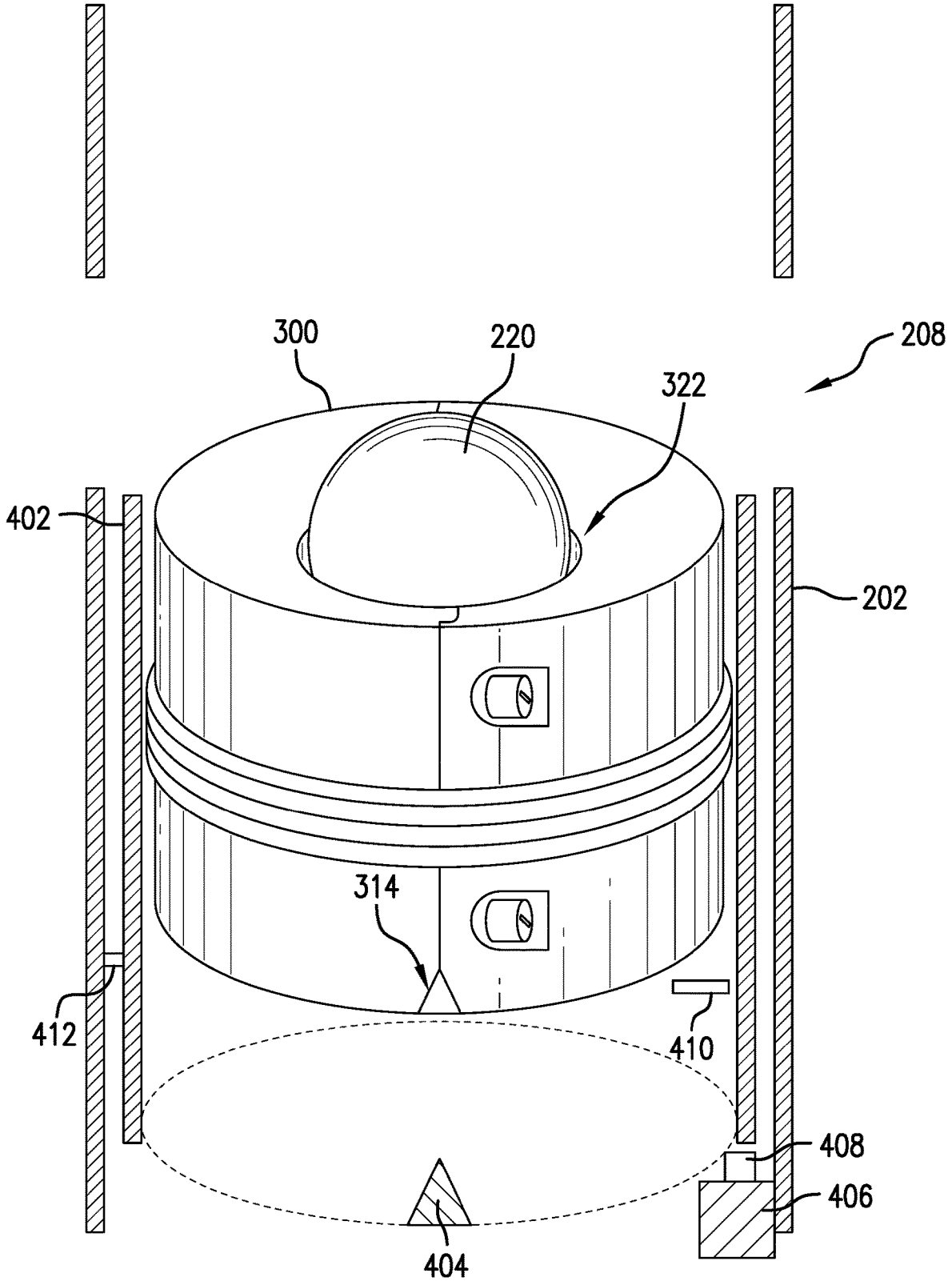
FIG. 5 shows a second operating stage of a frac assembly in which the port of a housing of the frac assembly is opened.

FIG. 5 shows a second operating stage in which the port 208 of the housing 202 is opened. A frac ball 220 is dropped into the housing 202 and is seated at the ridge 322 of the ball seat 300. The ball 220 blocks the fluid passage through the ball seat 300. Consequently, a build-up of fluid pressure at the first end of the ball seat 300 breaks the frac sleeve shear pin 412 and moves the frac sleeve assembly 400 towards the outlet, thereby compressing the biasing member 408 and opening port 208.

Figure 6:
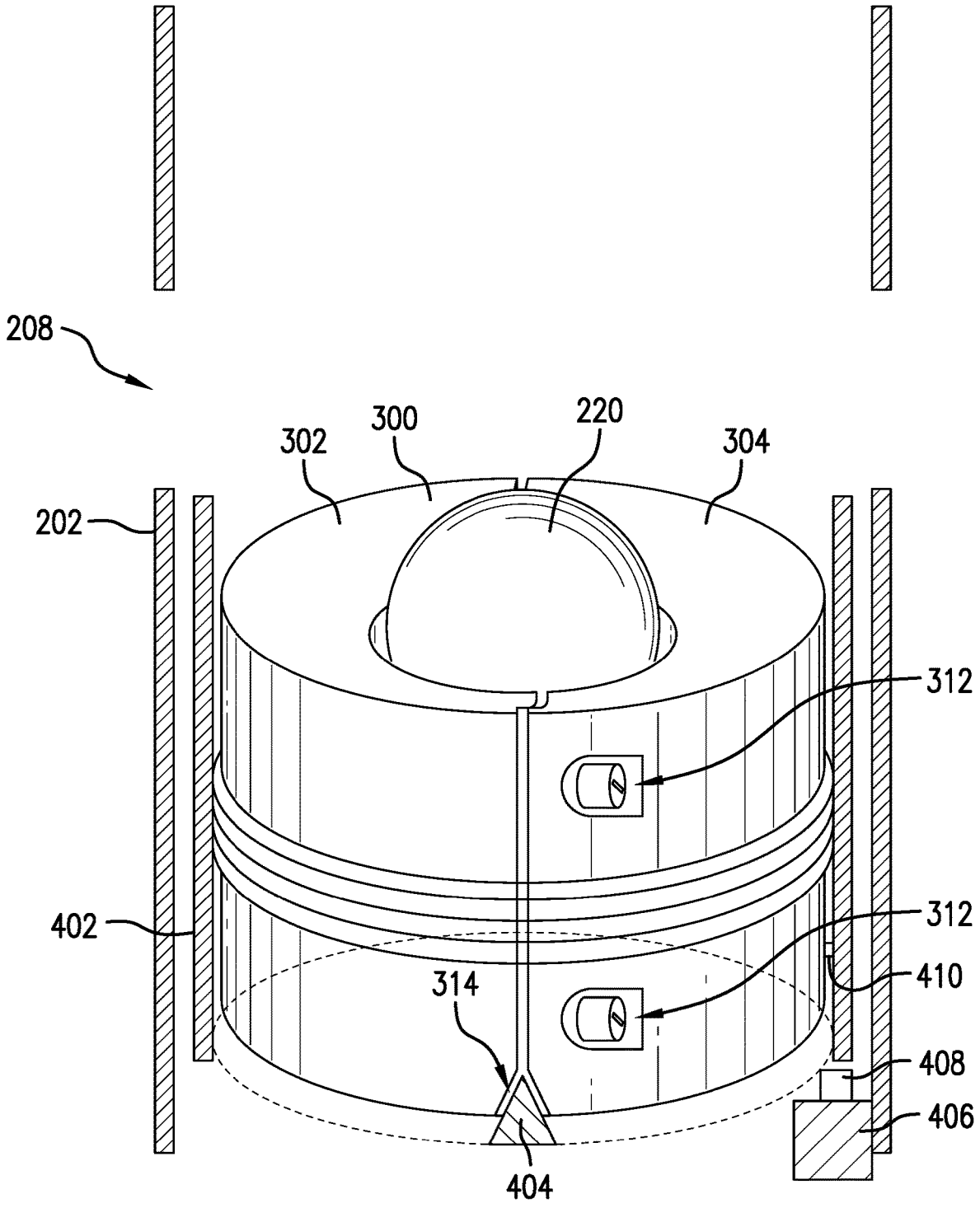
FIG. 6 shows a third ope g stage of the frac assembly in which the ball seat is fractured.

FIG. 6 shows a third stage in which the ball seat 300 is fractured. The fluid pressure is increased to break the ball seat shear pin 410. With the ball seat shear pin 410 broken, the ball seat 300 moves axially within sleeve 402 to engage the notch 314 with the profile 404, thereby breaking shear screws 312 and splitting the ball seat 300 into its two halves, i.e., first half 302 and second half 304. Once ball seat 300 is split, ball 220 passes through the ball seat 300, thereby opening up the fluid passage 215 in the ball seat 300.

Figure 7:
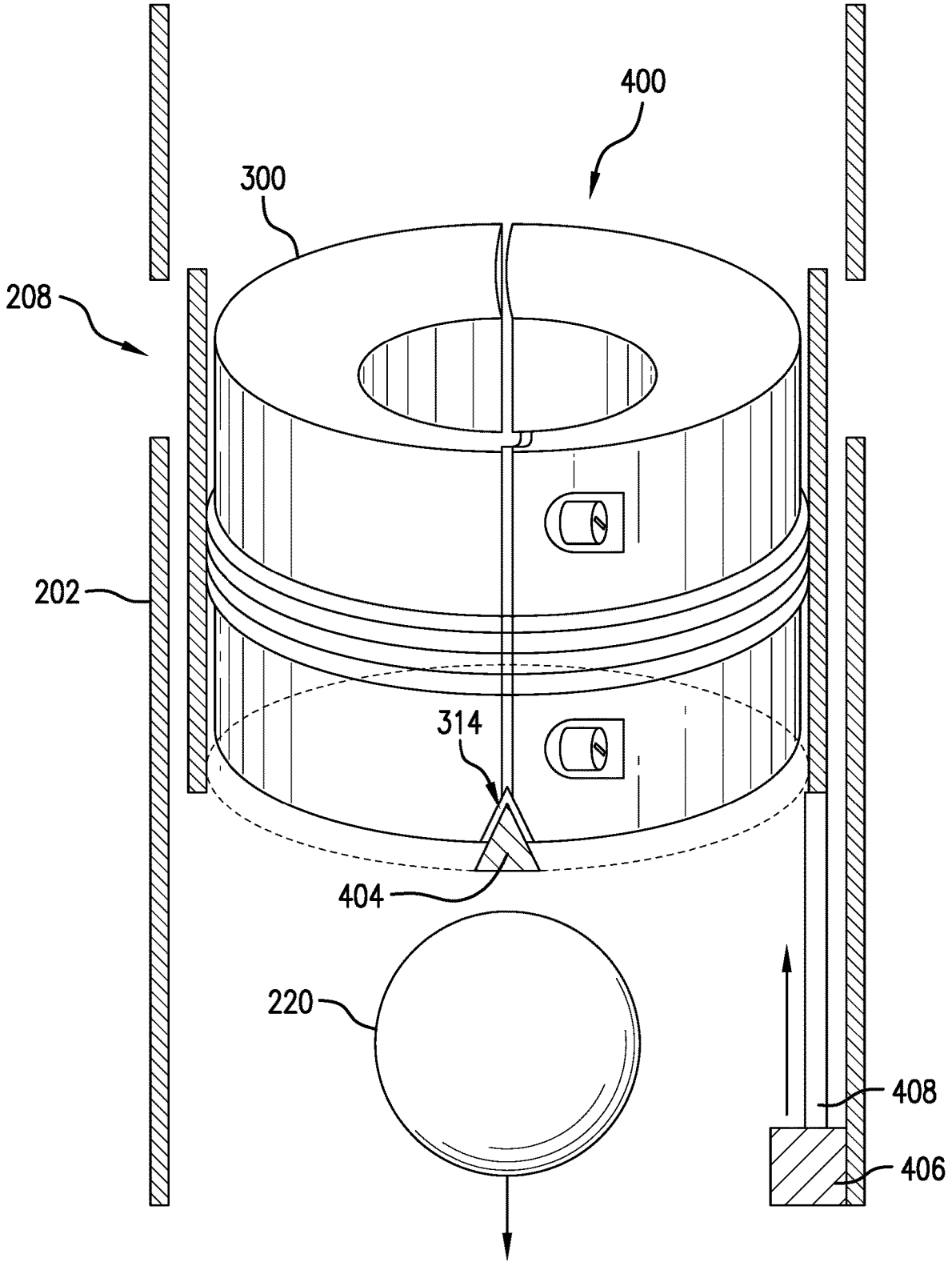
FIG. 7 shows a fourth operating stage in which the frac sleeve assembly is returned to its first position.

FIG. 7 shows a fourth stage in which the frac sleeve assembly 400 is returned to its first position. With the fluid passage in the ball seat 300 open, the fluid pressure is removed or reduced. The biasing member 408 thus provides the dominant force on the frac sleeve assembly 400, pushing the frac sleeve assembly 400 back into the first position at which location the frac sleeve assembly 400 closes the port 208.

Figure 8:
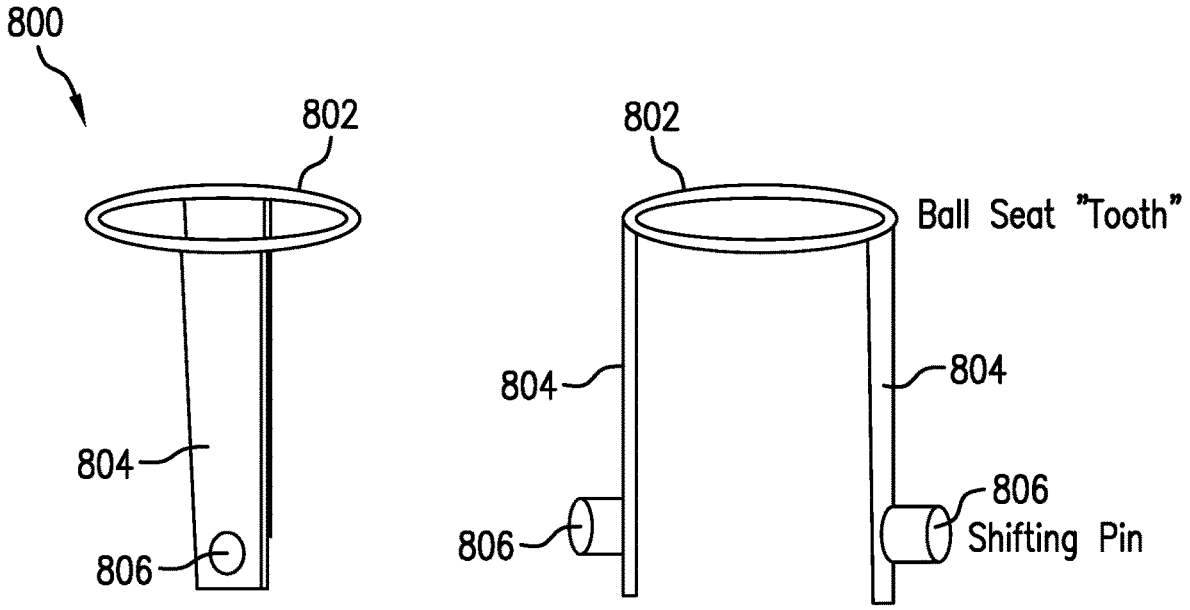
FIG. 8 shows side and front view of a ring assembly for use in another ball seat embodiment.

FIG. 8 shows side and front view of a ring assembly 800 for use in another ball seat embodiment. The ring assembly 800 includes a ring 802 and at least one arm 804 extending from a section of the ring 802. The at least one arm 804 includes a shifting pin 806. In various embodiments, the ring assembly 800 includes two arms 804 on radially opposite locations of the ring. Each of the arms 804 includes a shifting pin 806.

Figure 9:
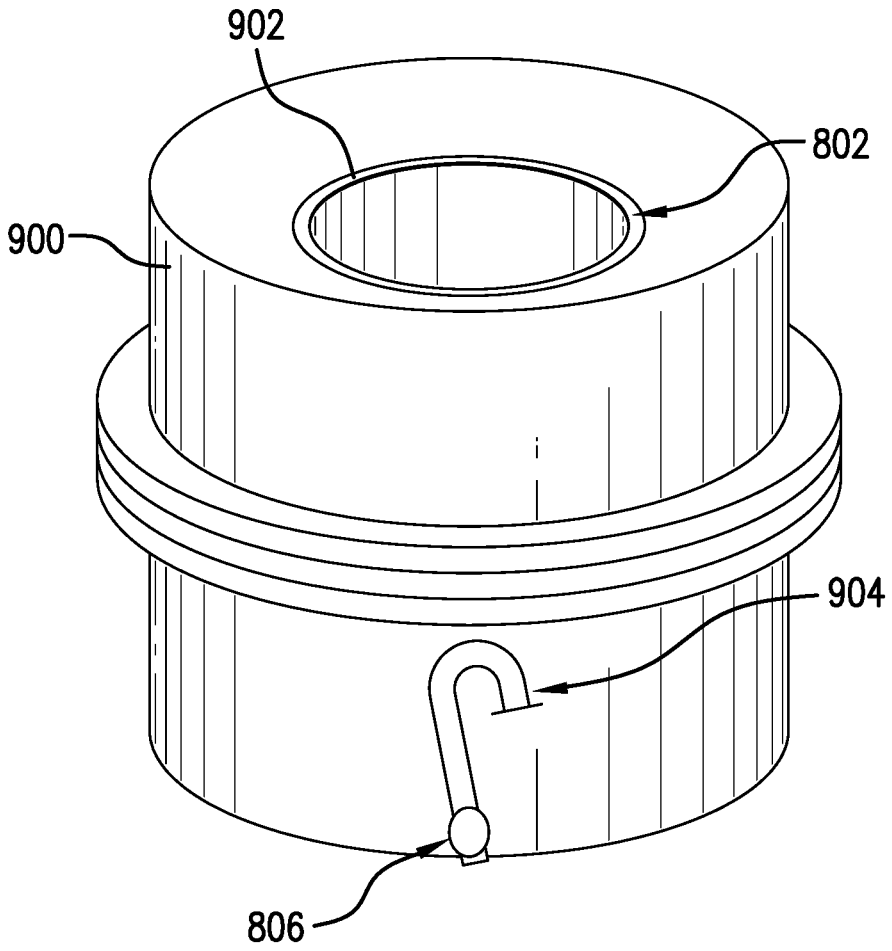
FIG. 9 shows a ball seat suitable for use with the ball seat ring assembly of FIG. 8.

FIG. 9 shows a ball seat 900 suitable for use with the ball seat ring assembly 800 of FIG. 8. The ring 802 of the ring assembly 800 resides at a ridge 902 of the ball seat 900. The arms 804 of the ring assembly 800 extend through the interior fluid passage of the ball seat 900 and the shifting pins 806 extends through respective slots 904 in a wall of the ball seat 900. In various embodiments, the slot 904 is a J-slot.

Figure 10:
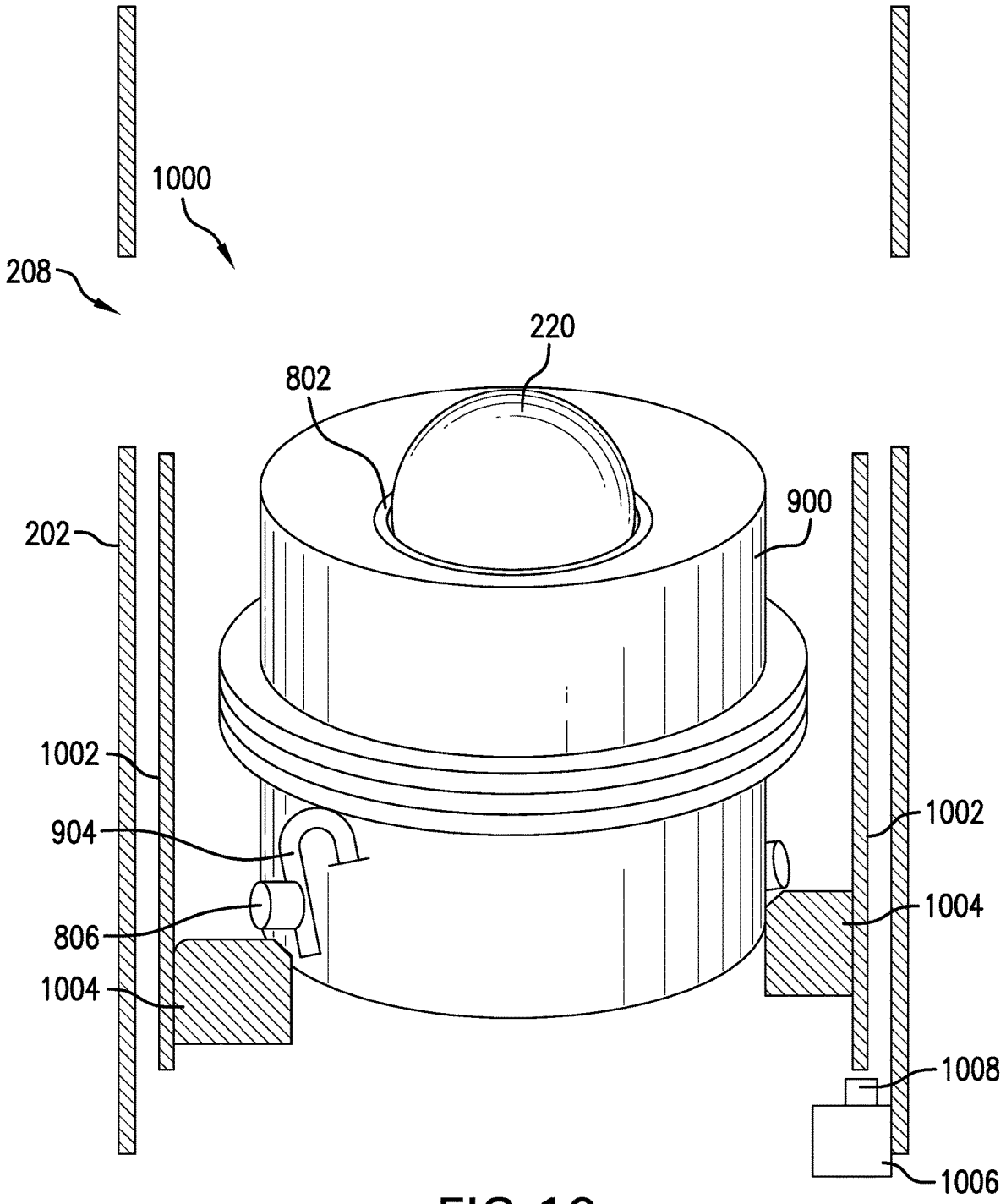
FIG. 10 shows a frac sleeve assemblyincluding the ball seat of FIG. 9 arranged within a sleeve.

FIG. 10 shows a frac sleeve assembly 1000 including the ball seat 900 arranged within a sleeve 1002. The frac sleeve assembly 1000 is slidable within housing 202 having port 208. A ball 220 is shown lodged at the ring 802 located at the ridge 902 of the ball seat 900. As a result the frac sleeve assembly 1000 has traveled axially with the housing 202 to open port 208. The ball seat 900 is slidably engaged within a sleeve 1002 of the frac sleeve assembly 1000. An inner surface of the sleeve 1002 includes a protrusion 1004, which can be one or more protrusions. In FIG. 10, the protrusion 1004 has not engaged the shifting pin 806. Since the ball 220 is lodged in the ring 802, the fluid passage 215 of the ball seat 900 is blocked, causing an increase in fluid pressure above the ball seat 900. The increased fluid pressure forces the ball seat 900 axially through sleeve 1002 to engage the protrusion 1004 to the shifting pin 806, as shown in FIG. 11.

Figure 11:
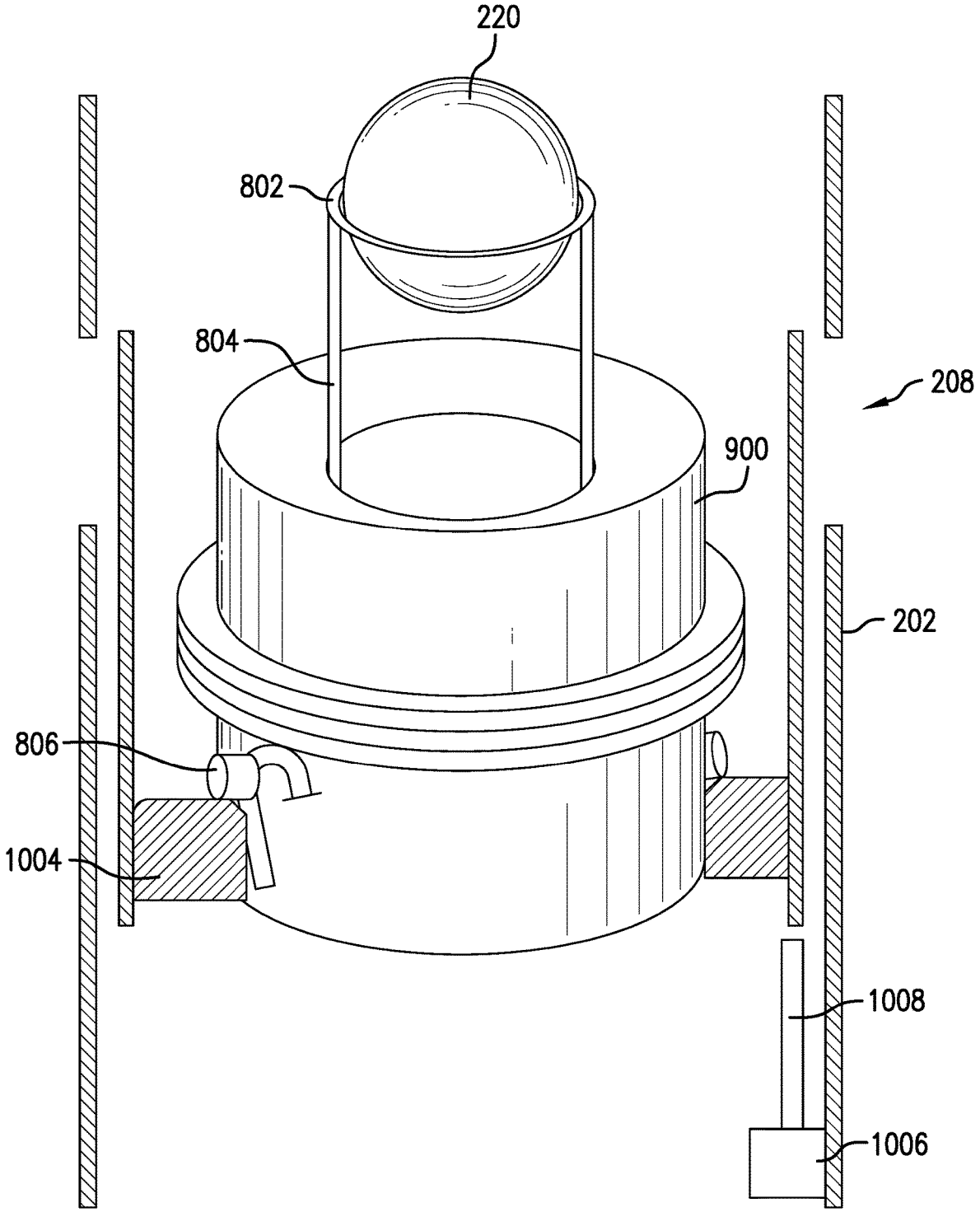
FIG. 11 shows the ball seat having moved axially through the sleeve to engage a protrusion to a shifting pin of the ring assembly.

FIG. 11 shows the ball seat 900 having moved axially through the sleeve 1102 to engage the protrusion 1004 with the shifting pin 806. The protrusion 1004 prevents further axial motion of the ring assembly 800 in the direction of the protrusion 1004. As the ball seat 900 traverse the axial location of the protrusion 1004, the ring assembly 800 and ball 220 are held in place by the protrusion 1004, thereby disengaging the ball 220 from the ridge 902 and opening the fluid passage. With the fluid passage upon, the biasing member forces the frac sleeve assembly back into position over the port 208. The ball 220 can be further disintegrated by a disintegrating fluid. Upon disintegration, the ball passes through the ring 802 and the ball seat 900.

Set forth below are some embodiments of the foregoing disclosure:

Embodiment 1: A frac sleeve assembly. The frac sleeve assembly includes a ball seat and a sleeve within which the ball seat moves. The ball seat has a first half and a second half, wherein the first half and the second half are matable to cooperatively retain a frac ball at the ball seat. The sleeve includes a profile configured to separate the first half and the second half to allow passage of the frac ball through the ball seat.

Embodiment 2: The frac sleeve assembly of any prior embodiment, wherein the first half and the second half are separated by a split defining an axially-extending plane.

Embodiment 3: The frac sleeve assembly of any prior embodiment, wherein the combined first half and second half form a notch configured to receive the profile when the ball seat moves with respect to the sleeve.

Embodiment 4: The frac sleeve assembly of any prior embodiment, further comprising shear screws for retaining the first half to the second half.

Embodiment 5: A method of operating a frac assembly. The method includes receiving a frac ball at a ball seat comprising a first half and a second half, wherein the first half and the second half are matable to cooperatively retain the frac ball at the ball seat; and moving the ball seat against a profile to separate the first half and the second half to allow passage of the frac ball through the ball seat.

Embodiment 6: The method of any prior embodiment, wherein the first half and the second half are separated by an axially-extending plane.

Embodiment 7: The method of any prior embodiment, further comprising moving the ball seat to receive the profile at a recess formed in the ball seat.

Embodiment 8: The method of any prior embodiment, wherein shear screws secure the first half to the second half via shear screws, further comprising breaking the shear screws by moving the ball seat against the profile.

Embodiment 9: A frac sleeve assembly. The frac sleeve assembly includes a ball seat, a ring assembly and a sleeve within which the ball seat moves. The ball seat includes a ridge for receiving a ball, and a slot. The ring assembly includes a ring and an associated shifting pin that extends through the slot. The sleeve has a protrusion that selectively engages the shifting pin to move the ring with respect to the ridge of the ball seat to release the ball from the ball seat.

Embodiment 10: The frac sleeve assembly of any prior embodiment, wherein the slot is a J-slot.

Embodiment 11: The frac sleeve assembly of any prior embodiment, wherein the ball seat moves axially within the sleeve to engage the shifting pin to the protrusion.

Embodiment 12: The frac sleeve assembly of any prior embodiment, wherein the ring is located at the ridge when the shifting pin is not engaged with the protrusion and wherein engaging the protrusion with the shifting pin to move the shifting pin through the slot moves the ring axially away from the ridge.

Embodiment 13: A method of operating a frac sleeve assembly. The method includes receiving a ball at a ridge of a ball seat of the frac sleeve assembly, the ball seat including a slot and a ring assembly, the ring assembly including a ring and an associated shifting pin that extends through the slot; and moving the ball seat within a sleeve having a protrusion in order to engage the protrusion with the shifting pin to move the ring with respect to the ridge of the ball seat to release the ball from the ball seat.

Embodiment 14: A method of any prior embodiment, wherein the slot is a J-slot.

Embodiment 15: A method of any prior embodiment, wherein the ring is located at the ridge when the shifting pin is not engaged with the protrusion and wherein engaging the protrusion with the shifting pin to move the shifting pin through the slot moves the ring axially away from the ridge.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another. The modifier "about" used in connection with a quantity is inclusive of the stated value and has the meaning dictated by the context (e.g., it includes the degree of error associated with measurement of the particular quantity).

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A frac sleeve assembly, comprising:

a ball seat having a first half and a second half, wherein the first half and the second half are matable to cooperatively retain a frac ball at the ball seat, the mating of the first half and the second half forming a split;

a notch at the split; and a sleeve within which the ball seat moves, the sleeve includes a profile configured to engage the notch, wherein engaging the profile with the notch separates the first half from the second half to allow passage of the frac ball through the ball seat.

2. The frac sleeve assembly of claim 1, wherein the split defines an axially-extending plane.

3. The frac sleeve assembly of claim 1, further comprising shear screws for retaining the first half to the second half, wherein engaging the profile with the notch breaks the shear screws.

4. A method of operating a frac assembly, comprising:

receiving a frac ball at a ball seat comprising a first half and a second half, wherein the first half and the second half are matable to cooperatively retain the frac ball at the ball seat, the mating of the first half and the second half forming a split, the ball seat including a notch at the split; and moving the ball seat to engage the notch to a profile, wherein engaging the notch with the profile separates the first half from the second half to allow passage of the frac ball through the ball seat.

5. The method of claim 4, wherein the split defines an axially-extending plane.

6. The method of claim 4, further comprising moving the ball seat to receive the profile at a recess formed in the ball seat.

7. The method of claim 4, wherein shear screws secure the first half to the second half via shear screws, further comprising breaking the shear screws by engaging the notch with the profile to break the shear screws.

* * * * *